US008955473B2

(12) United States Patent
Zhang

(10) Patent No.: US 8,955,473 B2
(45) Date of Patent: Feb. 17, 2015

(54) STRATEGY FOR ENGINE COLD START EMISSION REDUCTION

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 57 days.

(21) Appl. No.: 13/778,691

(22) Filed: Feb. 27, 2013

(65) Prior Publication Data

US 2014/0238318 A1 Aug. 28, 2014

(51) Int. Cl.
*F01P 11/02* (2006.01)
*F02F 1/10* (2006.01)

(52) U.S. Cl.
CPC ..... *F02F 1/10* (2013.01)
USPC ..... 123/41.14; 123/41.15; 60/274

(58) Field of Classification Search
CPC ... F01P 7/164; F01P 2025/44; F01P 2025/46; F01P 2037/02; F01P 5/00; F01P 7/04; F01N 11/00; F02D 41/0255; F02P 5/1506; Y02T 10/26; B60H 1/00885; B60H 1/025; F28D 20/00
USPC ..... 123/41.14, 41.15, 41.44; 60/323, 274, 60/300
See application file for complete search history.

(56) References Cited

U.S. PATENT DOCUMENTS

| | | | | |
|---|---|---|---|---|
| 1,676,961 | A * | 7/1928 | Muir | 123/41.14 |
| 2,054,525 | A * | 9/1936 | Simmen | 123/41.15 |
| 3,495,950 | A * | 2/1970 | Frost et al. | 60/299 |
| 6,634,323 | B2 | 10/2003 | Vaudry et al. | |
| 7,392,769 | B2 | 7/2008 | Heldberg | |
| 8,020,538 | B2 * | 9/2011 | Surnilla et al. | 123/568.12 |
| 8,079,214 | B2 * | 12/2011 | Son et al. | 60/323 |
| 8,156,903 | B2 | 4/2012 | Guala et al. | |
| 2010/0284832 | A1 | 11/2010 | Schmidt et al. | |
| 2011/0188987 | A1 | 8/2011 | Schmidt et al. | |

FOREIGN PATENT DOCUMENTS

EP 1403480 B1 * 8/2007

* cited by examiner

*Primary Examiner* — Noah Kamen
(74) *Attorney, Agent, or Firm* — Julia Voutyras; Alleman Hall McCoy Russell & Tuttle LLP

(57) ABSTRACT

A method for operating an engine having a cylinder head, comprising: following light-off of an exhaust catalyst from a cold-start condition, circulating liquid coolant through a cooling jacket of the cylinder head, and at a subsequent engine-off condition, draining at least some of the liquid coolant from the cooling jacket. In this way, at a cold start condition, the cooling jacket of the cylinder head may be filled with air, thus decreasing the amount of time needed for the exhaust catalyst to reach a light-off temperature.

12 Claims, 3 Drawing Sheets

STRATEGY FOR ENGINE COLD START EMISSION REDUCTION

BACKGROUND AND SUMMARY

Turbocharging an internal combustion engine can both reduce external emissions and increase the specific power output of the engine, as exhaust from the engine cylinders may be directed through a turbine and the resulting kinetic energy used to power a compressor. One example configuration integrates the exhaust manifolds leading from the engine cylinders to the turbine into the cylinder head itself, referred to as an integrated exhaust manifold.

The integrated exhaust manifold configuration may conserve heat energy from the exhaust gas, which may be transferred to the surrounding material of the cylinder head. This may in turn require cooling the cylinder head during normal engine operating conditions. In one example, liquid coolant may be circulated through chambers in the cylinder head, lowering the temperature of the cylinder head material and/or the exhaust gas exiting the exhaust manifold.

However, exhaust emission control devices, such as catalytic converters, achieve higher emission reduction after reaching a predetermined operating temperature. The inventors herein have realized that cooling the exhaust manifold with circulating liquid coolant may cool the exhaust gas and lengthen the amount of time necessary for the emission control device to reach the predetermined operating temperature following a cold-start condition. This may in turn increase engine emissions at cold start in the period of time before the emission control device has reached a predetermined operating temperature.

In one example, a method for operating an engine having a cylinder head, comprising: following light-off of an exhaust catalyst from a cold-start condition, circulating liquid coolant through a cooling jacket of the cylinder head, and at a subsequent engine-off condition, draining at least some of the liquid coolant from the cooling jacket. In this way, at a cold start condition, the cooling jacket of the cylinder head may be fully or partially filled with air, thus decreasing the amount of time needed for the exhaust catalyst to reach a light-off temperature. In another example, an engine system, comprising a cylinder head including a cooling jacket, a coolant tank coupled to the cooling jacket, and a coolant pump coupled to the cooling tank and cooling jacket, the coolant pump configured to circulate coolant during a first condition, and to drain coolant from the cooling jacket during a second condition. In this way, the cooling jacket may be filled with coolant during a first condition, and air-filled during a second condition, allowing improved control over the temperature of the cylinder head.

In another example, an engine method, comprising: draining a liquid cooling path following engine shut-down with the engine at rest and a coolant pump deactivated, cold-starting the engine from rest with the drained path and the pump still deactivated; and activating the pump after an exhaust catalyst reaches a light-off condition. In this way, liquid coolant is only circulated through the coolant path after the exhaust catalyst reaches the light-off condition.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
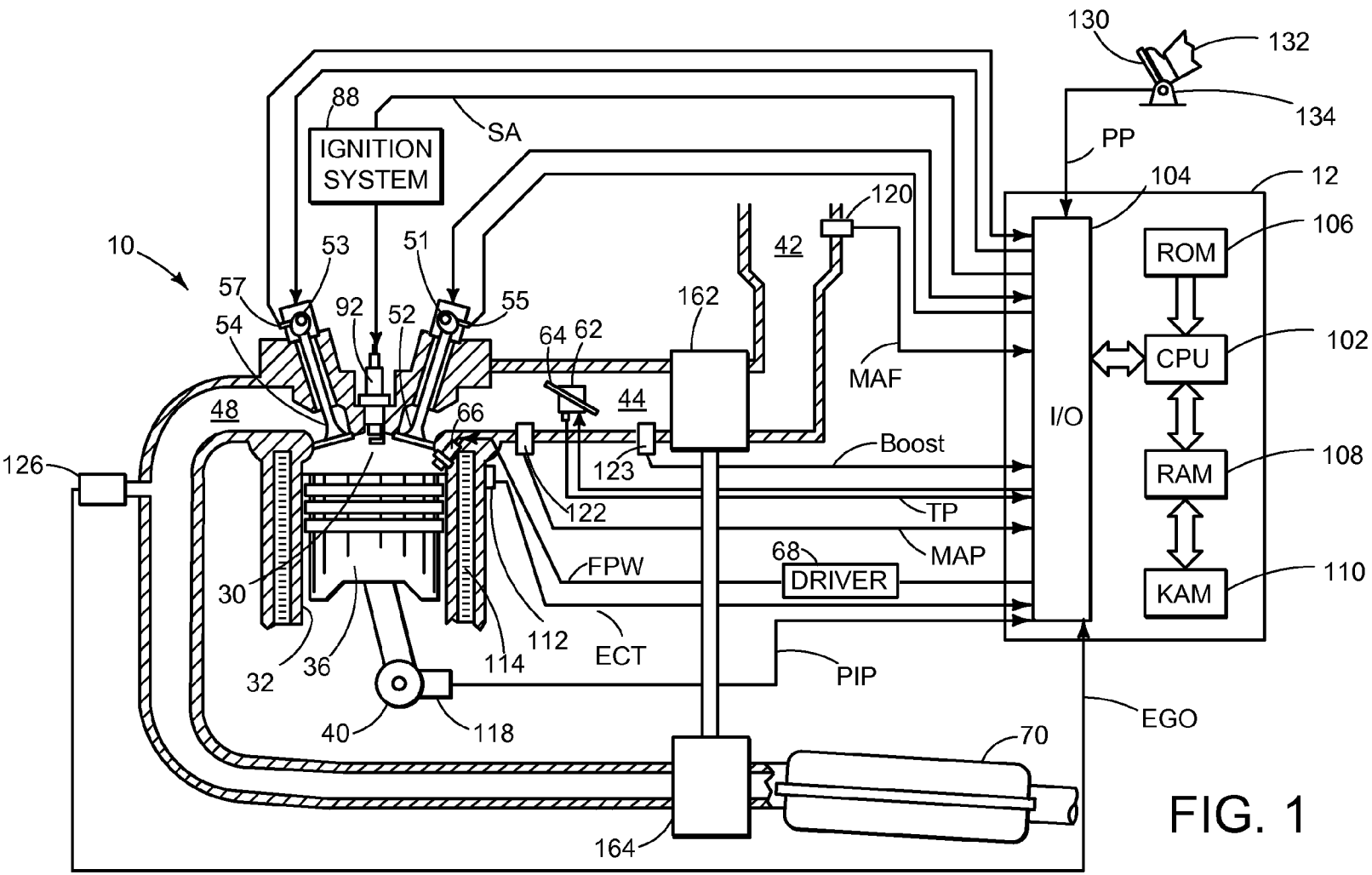
FIG. 1 shows a schematic diagram of an engine.
Figure 2:
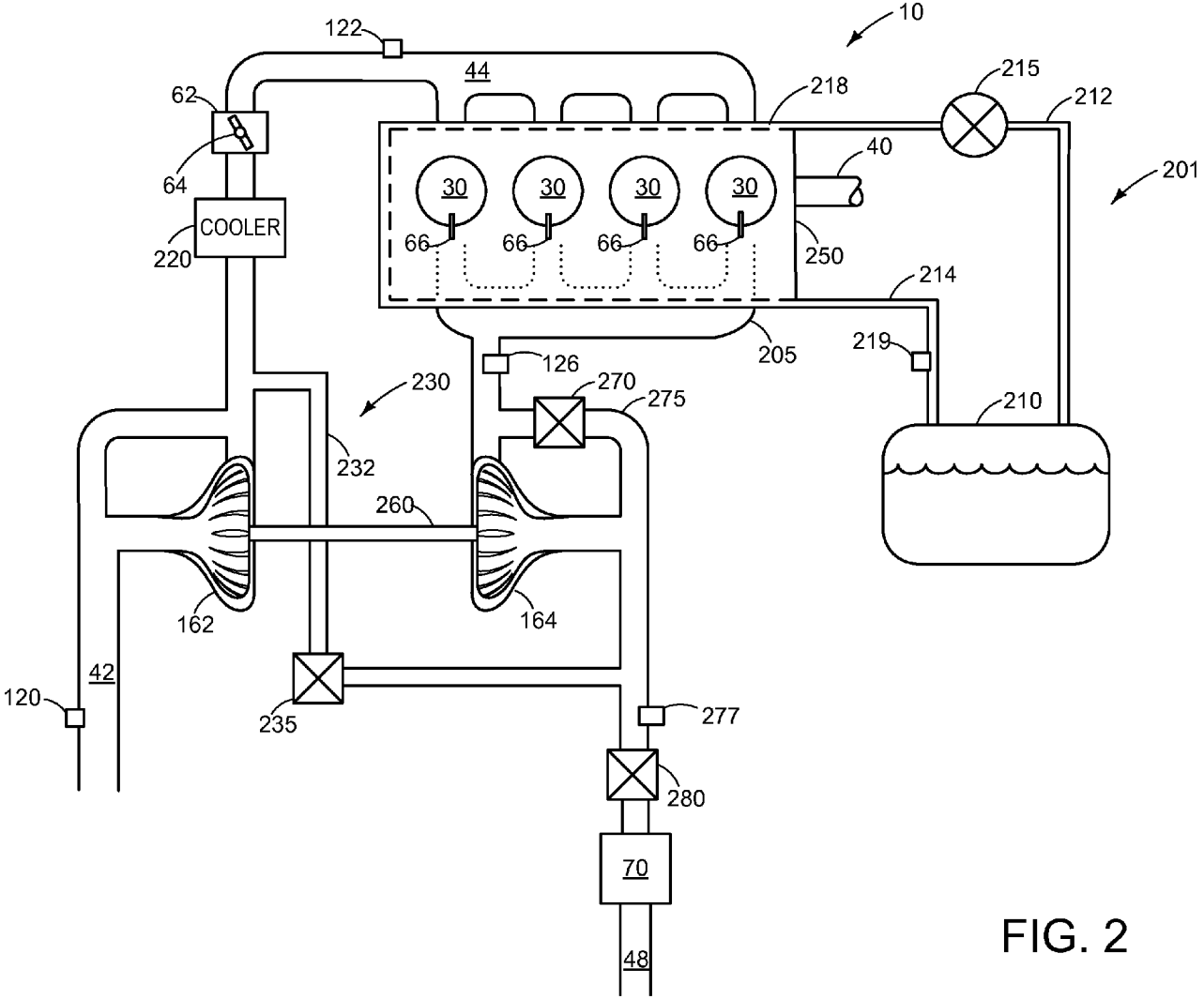
FIG. 2 shows a schematic diagram of an engine exhaust system for a turbocharged engine.

The present description relates to systems and methods for operating an internal combustion engine at a cold-start condition. In one non-limiting example, the engine may be configured as illustrated in FIG. 1. Further, additional components of an engine exhaust system as illustrated in FIG. 2 may be part of the engine of FIG. 1. A cold-start routine may be provided by the system illustrated in FIG. 2 and the method illustrated in FIG. 3, which shows an example method for operating an engine at a cold-start condition.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Engine 10 may further include a compression device such as a turbocharger or supercharger including at least a compressor 162 arranged along intake manifold 44. For a turbocharger, compressor 162 may be at least partially driven by a turbine 164 (e.g. via a shaft) arranged along exhaust passage 48. One or more of a wastegate and a compressor bypass valve may also be included to control flow through the turbine and compressor. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. Further, a sensor 123 may be disposed in intake manifold 44 for providing a BOOST signal to controller 12.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

FIG. 2 is a schematic diagram of a turbocharged engine 10 in accordance with the present disclosure. As depicted, cylinder head 250 includes four cylinders 30 in a straight line conformation, but may include a lesser or greater number of cylinders, for example six cylinders. The cylinders may be arranged in an inline conformation as shown or in other conformations such as an opposed or V conformation, for example a V-6 engine. Each cylinder 30 is shown with a fuel injector 66. Fuel injector 66 may be configured as a direct fuel injector or a port fuel injector. In one example, the engine may be configured to run on multiple fuel sources, for example a liquid fuel such as gasoline along with a gaseous fuel such as CNG. In this example, each cylinder may have a separate fuel injector for each fuel source.

As also shown in FIG. 1, the cylinders 30 may receive intake air from intake manifold 44 via intake passage 42. Intake passage 42 may further include throttle 62, throttle plate 64, MAF sensor 120 and MAP sensor 122. A charge air cooler 220 may be disposed within intake passage 42 downstream of a compressor 162.

Exhaust from cylinders 30 may exit cylinder head 250 via exhaust passage 48. Exhaust passage 48 may be connected to cylinders 30 via exhaust manifold 205. As shown in FIG. 2, exhaust manifold 250 may be wholly or partially included within cylinder head 250. It will be appreciated that this conformation may be referred to as an "integrated exhaust manifold". Exhaust manifold 205 may include a plurality of exhaust runners coupled to cylinder exhaust ports via exhaust valves.

Exhaust passage 48 may include turbine 164. Turbine 164 may be configured as a radial turbine or as an axial turbine. Turbine 164 may include a single spool or multiple spools. Turbine 164 may be coupled to compressor 162 via common shaft 260. Exhaust passage may further include wastegate passage 275. Wastegate valve 270 may be deposed at the entrance of wastegate passage 275. Wastegate valve 270 may be configured to open or close in response to signals received from controller 12. In this way, the amount of exhaust gas bypassing turbine 164 may be controlled in response to engine operating conditions. Exhaust passage 48 may further include temperature sensor 277, backflow valve 280 and emission control device 70.

Engine 10 may further include a port electric thermactor air (PETA) system 230, air injection reactor system or similar. PETA system 230 may allow for oxygen rich air from intake passage 42 to be delivered to exhaust passage 48 upstream of emission control device 70. In this way, unburnt hydrocarbons in the exhaust gas may be further combusted prior to reaching emission control device 70, which may reduce vehicle emissions.

PETA system 230 may include a PETA line 232. PETA line 232 may have an inlet coupled to intake passage 42 and an outlet coupled to exhaust passage 48. The inlet may include a filter or other device configured to purify air entering PETA line 232. In some examples, PETA line 32 may have an additional outlet coupled to emission control device 70. A PETA valve 235 may be deposed along PETA line 232. PETA valve 235 may prevent the backflow of exhaust gas and further regulate the flow of air from the intake passage. In some examples, a vane pump or other air induction device may be coupled to PETA line 232 to draw air from intake passage 42. The air induction device may be further coupled to engine 10 with a drive belt or electric motor or other such means of driving the induction device with energy generated by engine 10.

As shown in FIG. 2, engine 10 may include a cooling system 201. Cooling system 201 may include cooling jacket 218 coupled to cylinder head 250. Cooling jacket 218 may be configured to cool an integrated exhaust manifold, such as exhaust manifold 205. Cooling jacket 218 may be coupled to tank 210 via supply line 212 and return line 214. A coolant pump 215 may be coupled to supply line 212. In this way, coolant may be drawn from tank 210 through supply line 212, pumped into cooling jacket 218, and returned to tank 210 via return line 214. Tank 210 may be located at a lower point than cylinder head 250, such that coolant may passively return to tank 210 through return line 214. In this example, coolant in cooling jacket 218 may also return to tank 210 through supply line 212 in situations where coolant pump 215 is not active. A thermostat 219 may be coupled to return line 214. Thermostat 219 may be configured to restrict flow of coolant when the coolant is below a threshold temperature and to permit flow of coolant when the coolant is above the threshold temperature. Thermostat 219 may be in fluid communication with coolant pump 215 via controller 12 in order to regulate the activation status of the coolant pump. For example, if coolant jacket 218 is filled with coolant that is below the threshold temperature, coolant pump 215 may be deactivated in response to signals from thermostat 219 until the coolant in the coolant jacket reaches the threshold temperature.

As described above, PETA system 230 may be employed to reduce engine emissions by stimulating exhaust combustion within exhaust line 48. Cooling system 201 may also be used to reduce engine emissions. In one example, the water pump may be inactive at a cold start condition. In this way, cooling jacket 218 will be filled with air, having drained coolant to tank 210 at key-off. Thus, exhaust gas from cylinders 30 may remain heated while passing through emission control device 70. This in turn may decrease the amount of time needed to activate a catalyst within emission control device 70 as compared to a system where the exhaust gas is cooled upon exiting cylinders 30.

Figure 3:
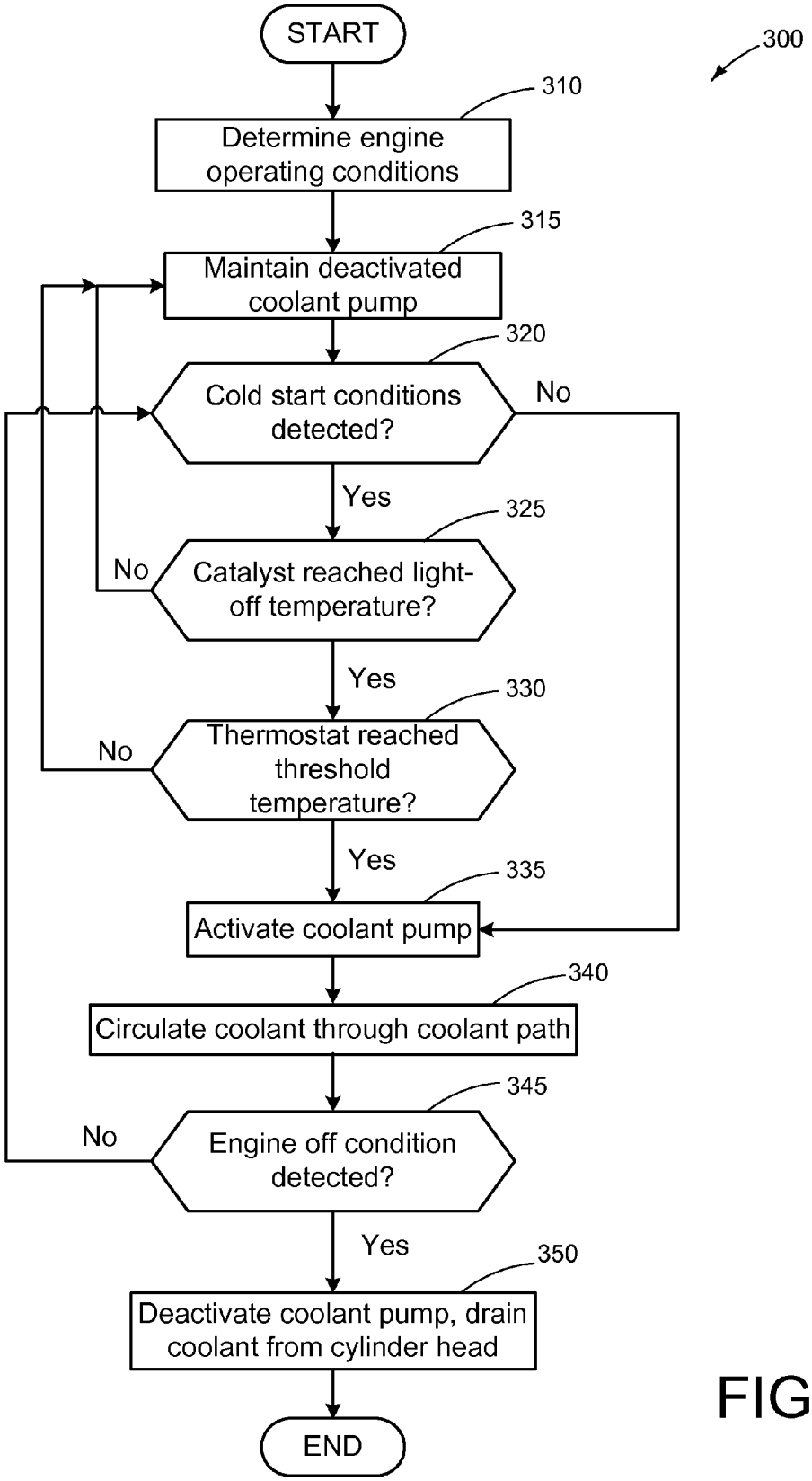
FIG. 3 is a flow chart illustrating an example method for operating an engine at a cold-start condition in accordance with the present disclosure.

FIG. 3 shows an example method 300 for an engine cold start routine in accordance with the present disclosure. Method 300 may be implemented by controller 12 as depicted in FIG. 1. Method 300 may be run at key-on (which may include a remote-start or push-button start), or at another suitable time point following engine start-up. At 310, method 300 may include measuring and/or determining the engine operating conditions. Conditions assessed may include barometric pressure, driver-demanded torque, manifold pressure, manifold air flow, engine temperature, air temperature, and other operating conditions. At 315, method 300 may include maintaining the deactivation status of a coolant pump, for example coolant pump 215 as depicted in FIG. 2. If the coolant pump has already been activated, method 300 may include deactivating the coolant pump.

At 320, method 300 may determine if cold start conditions have been detected based on the operating conditions assessed at 310. For example, controller 12 may determine if the duration between the last engine-off condition and the current start condition is greater than a threshold duration, for example 2 hours. In some examples, a cold start condition may be determined by comparing an engine temperature to a threshold. If cold start conditions are not detected, routine 300 may proceed to 335. If cold start conditions are detected, routine 300 may proceed to 325. At 325, method 300 may include determining if a catalyst has reached light-off temperature. The catalyst may be included in emission control device 70 or other suitable devices for adsorbing compounds from exhaust gas located in exhaust passage 48. In one example, a controller may take a thermocouple reading from a sensor located inside or between catalyst substrates. The light off temperature may be 200° C., for example, or may be a higher or lower temperature depending on the nature of the catalyst. In some examples, controller 12 may assess the temperature of exhaust gas in exhaust passage 48 with temperature sensor 277 or another suitable temperature sensor. In some examples, the exhaust temperature may be estimated as a function of the engine operating conditions and the amount of time elapsed from the beginning of the cold start routine. In some examples, a predetermined amount of time may be allowed to elapse from the beginning of the cold start routine, for example 20 seconds. The time allowed to elapse may be empirically determined for a particular engine under operating conditions assessed at 310. The ignition timing may also be retarded in order to increase the temperature of exhaust gas exiting cylinders 30 during the cold start routine. In some examples, controller 12 may activate PETA system 230 in order to increase the temperature of exhaust in exhaust passage 48. When the catalyst has reached light-off temperature, method 300 may proceed to 330.

At 330, method 300 may include determining if a thermostat (e.g. thermostat 219 as depicted in FIG. 2) has reached a threshold temperature, for example 40° C. If the thermostat has not reached the threshold temperature, method 300 may return to 315. If the thermostat has reached the threshold temperature, method 300 may proceed to 335.

At 335, method 300 may include activating a coolant pump, for example coolant pump 215 depicted in FIG. 2. As shown in FIG. 2, Coolant pump 215 may draw coolant from tank 210 through supply line 212, and pump coolant into cooling jacket 218. At 340, method 300 may include circulating coolant through a coolant path. In some examples, activating the coolant pump may be sufficient to circulate coolant through the coolant path. In other examples, activating the pump may fill the coolant path with coolant, but coolant may not freely circulate through the coolant path until an impediment has been removed. For example, upon the catalyst reaching light-off temperature, coolant pump 215 may be activated, filling cooling jacket 218 with coolant. If the coolant is below threshold temperature, thermostat 219 may impede flow of coolant through return line 214. Coolant pump 215 may be deactivated in response to a signal from controller 12. When the coolant reaches the threshold temperature, thermostat 219 may permit the flow of coolant through return line 214, and coolant pump 215 may be activated in response to a signal from controller 12. In this way, coolant may enter cooling jacket 218 after catalyst light-off, but may not circulate through cooling jacket 218 until the coolant has reached the threshold temperature.

At 345, method 300 may include determining whether an engine-off condition has been detected. If an engine off-condition has not been detected, method 300 may return to 320. If an engine off-condition has been detected, method 300 may proceed to 350. At 350, method 300 may include deactivating a coolant pump, for example coolant pump 215, and draining the coolant from a cylinder head. Deactivating coolant pump 215 may allow coolant in cooling jacket 218 to return to tank 210 via return line 214 and/or supply line 212, provided tank 210 is located at a lower point in the engine cavity than is cylinder block 250. In some examples, coolant may be actively pumped out of the coolant path, by coolant pump 215 or another pump coupled to the coolant path.

In this way, method 300 may allow for cooling jacket 218 to be air filled during a cold start condition. As air has a significantly lower thermal conductivity and thermal capacity than does a liquid coolant (e.g. water), exhaust gas exiting cylinders 30 will retain more heat if cooling jacket 218 is filled with air rather than a liquid coolant. This in turn may allow a catalyst to reach light-off temperature rapidly, thus decreasing emissions during a cold start routine. Once the catalyst has reached light-off temperature, the water pump may be activated, filling cooling jacket 218 with coolant, and reducing the temperature of exhaust exiting cylinders 30. By placing tank 210 at a lower point in the engine cavity from cylinder block 250, coolant may drain from cooling jacket 218 when coolant pump 215 is turned off. Thus, method 300 provides one example of a method for providing a cooling jacket filled with air at a cold-start condition and filled with liquid-coolant during other engine operating conditions.

It will be appreciated that the configurations and methods disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an engine having a cylinder head, comprising:

cold-starting the engine with a cooling jacket air-filled, and following both light-off of an exhaust catalyst from the cold-start and a thermostat reaching a threshold activation temperature, circulating liquid coolant through a cooling jacket of the cylinder head;

at a subsequent engine-off condition, draining the liquid coolant from the cooling jacket.

2. The method of claim 1, where circulating liquid coolant through the cooling jacket includes activating a coolant pump coupled to a coolant tank from a deactivated condition.

3. The method of claim 1, further comprising, at the subsequent engine-off condition, de-activating a coolant pump coupled to a coolant tank from an activated condition.

4. The method of claim 3, where the coolant tank is positioned lower in an engine cavity than the cylinder head.

5. The method of claim 4, where the cooling jacket is coupled to the coolant tank with a coolant supply line and a coolant return line.

6. The method of claim 1, where the cylinder head further includes an exhaust manifold within the cylinder head.

7. The method of claim 1, where the engine is a turbocharged engine.

8. The method of claim 7, further including: prior to light-off of the exhaust catalyst, injecting intake air upstream of the exhaust catalyst.

9. An engine method, comprising:

draining a liquid cooling path following engine shut-down with the engine at rest and a coolant pump deactivated;

cold-starting the engine from rest with the drained path and the pump still deactivated; and activating the pump after an exhaust catalyst reaches a light-off condition, wherein the light-off condition includes catalyst temperature above a threshold temperature, wherein the cooling path is positioned in an integrated exhaust manifold in an engine cylinder head, and wherein activating the coolant pump includes filling the drained path with coolant, wherein a thermostat is coupled to the cooling path, and wherein the thermostat restricts flow of coolant when the coolant is below a threshold temperature and wherein the coolant pump is deactivated following filling the drained path with coolant when the thermostat restricts flow of coolant, and reactivated to allow circulation of coolant when the thermostat permits flow of coolant.

10. An engine method, comprising:

while a coolant pump is deactivated:

draining a liquid cooling jacket in a cylinder head following engine shut-down cold-starting the engine from rest with the jacked drained;

activating the pump after an exhaust catalyst reaches a light-off condition; and deactivating the coolant pump following filling the drained jacket when a thermostat restricts flow of coolant, and reactivating the pump to circulate coolant when the thermostat permits coolant flow.

11. The method of claim 10, wherein the light-off condition includes catalyst temperature above a threshold temperature, wherein the cooling jacket is positioned in an integrated exhaust manifold in the cylinder head, and wherein activating the coolant pump includes filling the jacket with coolant.

12. The method of claim 10, wherein the thermostat is coupled to the jacket, and wherein the thermostat restricts flow of coolant when the coolant is below a threshold temperature.

* * * * *